US007291777B2

(12) United States Patent
Chen

(10) Patent No.: US 7,291,777 B2
(45) Date of Patent: Nov. 6, 2007

(54) CAPTIVE WASHERS OF A DRUM

(76) Inventor: Kuo-Chang Chen, No. 32, Doutan Rd., Shalu Chen, Taichung Hsien (TW)

( * ) Notice: Subject to any disclaimer, the term of this patent is extended or adjusted under 35 U.S.C. 154(b) by 29 days.

(21) Appl. No.: 11/331,761

(22) Filed: Jan. 13, 2006

(65) Prior Publication Data

US 2007/0131087 A1 Jun. 14, 2007

(30) Foreign Application Priority Data

Dec. 9, 2005 (TW) ..... 94221483 U

(51) Int. Cl.
*G10D 13/02* (2006.01)

(52) U.S. Cl. ..... 84/421

(58) Field of Classification Search ..... 84/411 R, 84/421

See application file for complete search history.

(56) References Cited

U.S. PATENT DOCUMENTS 4,630,521 A * 12/1986 Alletto ..... 84/413
5,106,250 A * 4/1992 Fischer et al. ..... 411/107
2006/0156898 A1* 7/2006 Nickel ..... 84/411 R

* cited by examiner

*Primary Examiner*—Kimberly Lockett
(74) *Attorney, Agent, or Firm*—Alan Kamrath; Kamrath & Associates P.A.

(57) ABSTRACT

Captive washers are used with tension control devices on a drum having a drum shell, two drum hoops, two drumheads and multiple tension control devices. Each tension control device is mounted on the drum shell and has a mounting post, a connector and two adjusting bolts. Each captive washer presses against the drum hoop and has a flange, a lip, an annular groove and a through hole. The annular groove is formed between the flange and the lip and is mounted securely in an elongated groove in the drum hoop to hold the captive washer in the drum hoop. The through hole extends longitudinally through the captive washer.

7 Claims, 6 Drawing Sheets

CAPTIVE WASHERS OF A DRUM

BACKGROUND OF THE INVENTION

1. Field of the Invention

The present invention relates to a captive washer, and more particularly to a captive washer that adjusts tension of a drum and reduces vibration of the drum.

2. Description of Related Art

With reference to FIGS. 4 and 5, a conventional drum normally comprises a cylindrical drum shell (50), multiple tension control devices (60), two annular drum hoops (52) and two drumheads (51). The cylindrical drum shell (50) includes two round openings and a sidewall. The tension control devices (60) are mounted on the sidewall of the drum shell (50). The annular drum hoops (52) are mounted respectively on the two openings, and each drum hoop (52) has multiple elongated holes (520). The elongated holes (520) are elongated circumferentially, are formed through the annular drum hoops (52) and align respectively with the tension control devices (60). The drumheads (51) are mounted respectively in the annular drum hoops (52), cover the two openings, are made of leather or similar resilient material and have a tension. The tension of the drumheads (51) determines a drum's tone and is controlled by the tension control devices (60) drawing the drum hoops (52) closer together to increase the tension of the drumheads (51).

With further reference to FIG. 6, a conventional tension control device (60) has a mounting post (62), a connector (63), two washers (65) and two adjusting bolts (61). The mounting post (62) is attached to and protrudes out radially from the sidewall of the shell (50) and has a proximal end, a distal end and a mounting hole. The proximal end of the mounting post (62) is attached securely to sidewall of the drum shell (50), and the mounting hole is formed transversely through the mounting post (62) near the distal end. The connector (63) is tubular and is mounted slidably through the mounting hole and has two ends, an attachment hole (631) and an internal thread. The ends are opposite to each other. The attachment hole (631) extends axially through the connector (63), and the internal thread is defined longitudinally in the connector (63). The washers (65) press respectively against the drum hoops (52) at the elongated holes (520), and each washer (65) has a through hole (651). The through hole (651) is formed through the washer (65) and communicates with the elongated hole (520). The adjusting bolts (61) are mounted respectively through the through holes (651) in the washers (65) and two corresponding elongated holes (520) respectively in the drum hoops (52) and are screwed respectively into opposite ends of the connector (63). Each adjusting bolt (61) has a proximal end, a distal end, a flange and a thread. The flange is formed near the distal end of the adjusting bolt (61) and presses against the washer (65). The proximal ends of the adjusting bolts (61) are screwed respectively into the ends of the connector (63) to adjust the distance between the drum hoops (52) and the tension on the drumheads (51).

However, defects and restrictions of conventional washers (65) of tension control devices (60) for a drum follow.

1. The washers (65) being mounted between the flanges of the adjusting bolts (61) and the elongated holes (520) of the drum hoops (52) absorb vibration from the drum hoops (52). However, the adjusting bolts (61) press against the elongated holes (520) opposite to the washers (65), which causes the vibration between the adjusting bolts (61) and the elongated holes (520) of the drum hoops (52) to loosen the adjusting bolts (61) from the connector (63). Consequently, the tone of the drumheads (51) change while the drum is played.

2. Changing the drumheads (51) necessitates removal of the adjusting bolts (61) from the connector (63) of the tension control device (60) and the elongated holes (520) in the corresponding drum hoop (52). Consequently, the washers (65) may be lost in the process, which would be very inconvenient and could keep the drum from being used unless a replacement washer was available.

Therefore, the invention provides a captive washer to mitigate or obviate the aforementioned problems.

SUMMARY OF THE INVENTION

The main objective of the present invention is to provide captive washers for a drum that can reduce vibration when the drum is played.

Captive washers in accordance with the present invention are used with tension control devices on a drum having a drum shell, two drum hoops, two drumheads and multiple tension control devices. Each tension control device is mounted on the drum shell and has a mounting post, a connector, two captive washers and two adjusting bolts. Each captive washer presses against the drum hoop and has a body, an annular groove, a lip and a through hole. The annular groove is formed between the flange and the lip. The through hole extends longitudinally through the captive washer. The lip locks the captive washer in an elongated through hole formed through the annular drum hoop.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
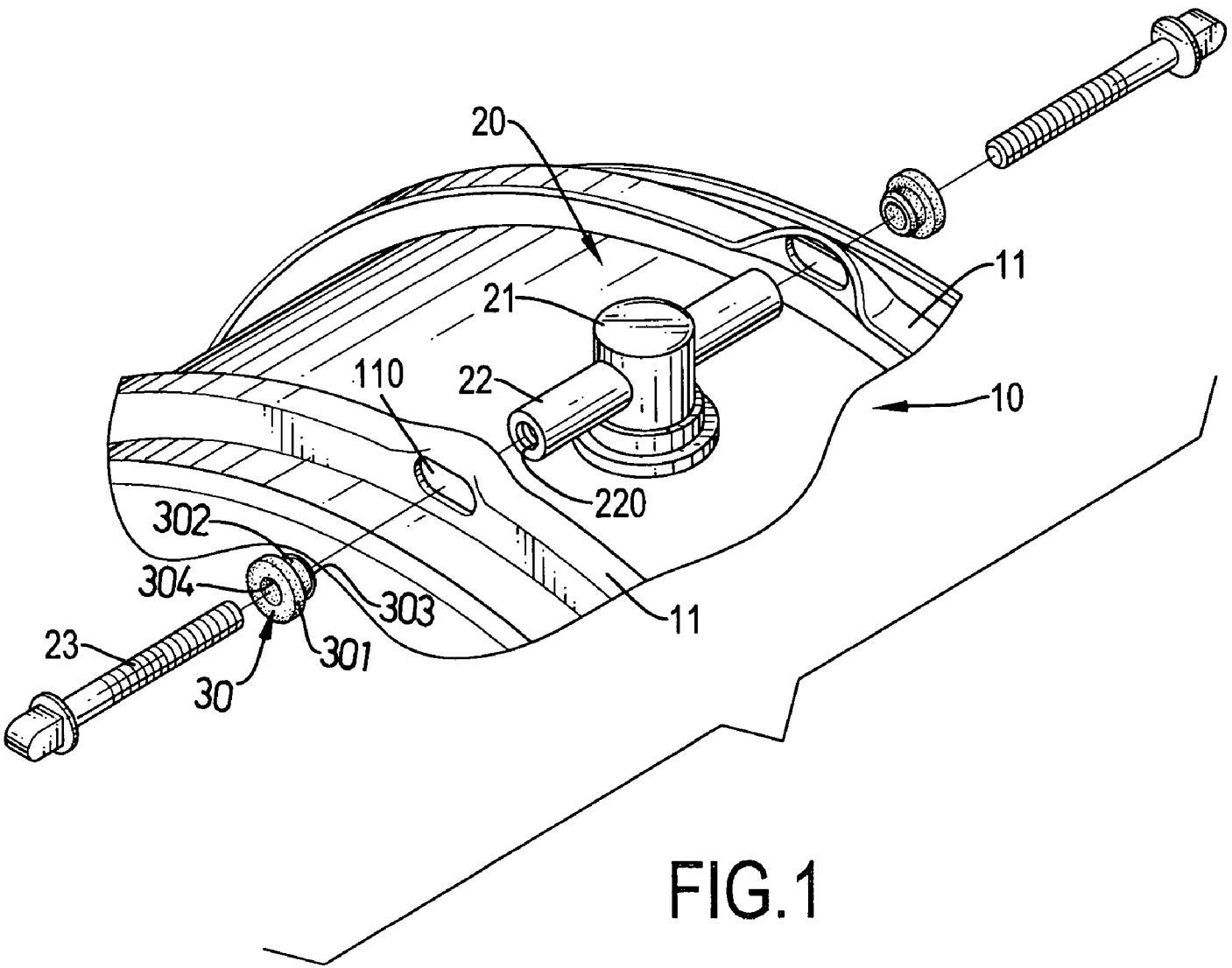
FIG. 1 is an exploded perspective view of a tension control device for a drum assembly with captive washers in accordance with the present invention.
Figure 2:
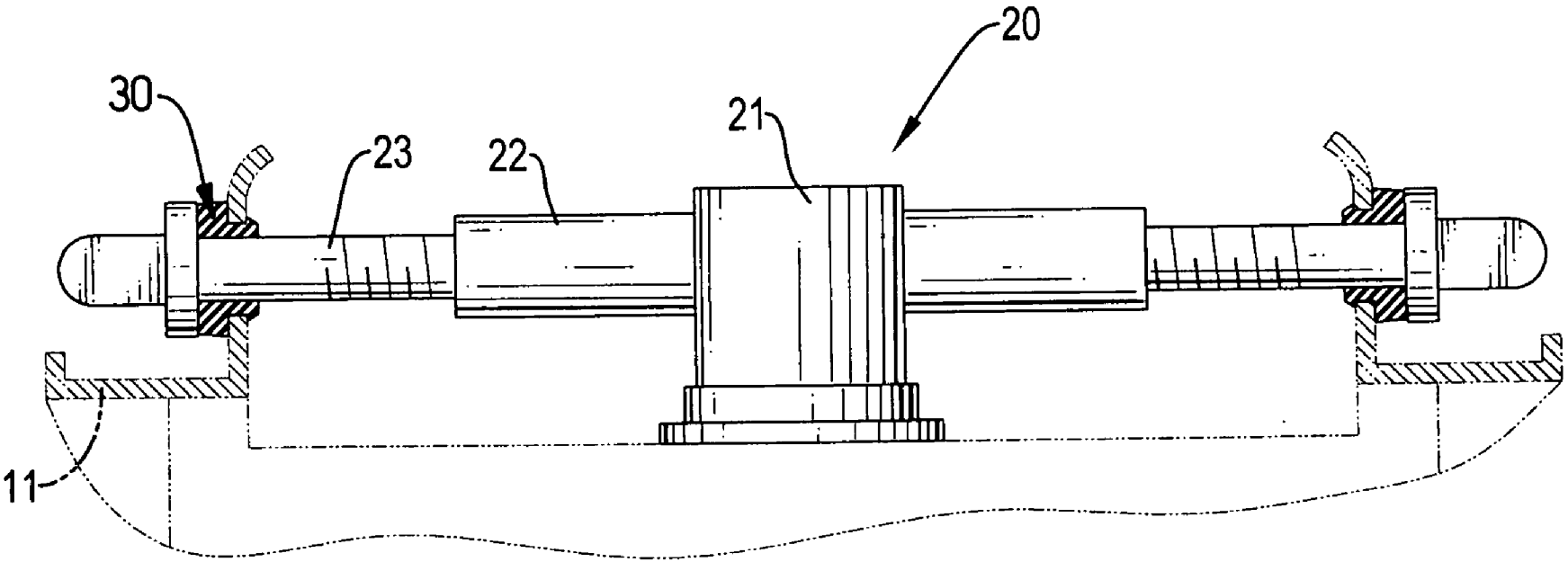
FIG. 2 is a side view in partial section of a tension control device on a drum with the captive washers in FIG. 1.
Figure 3:
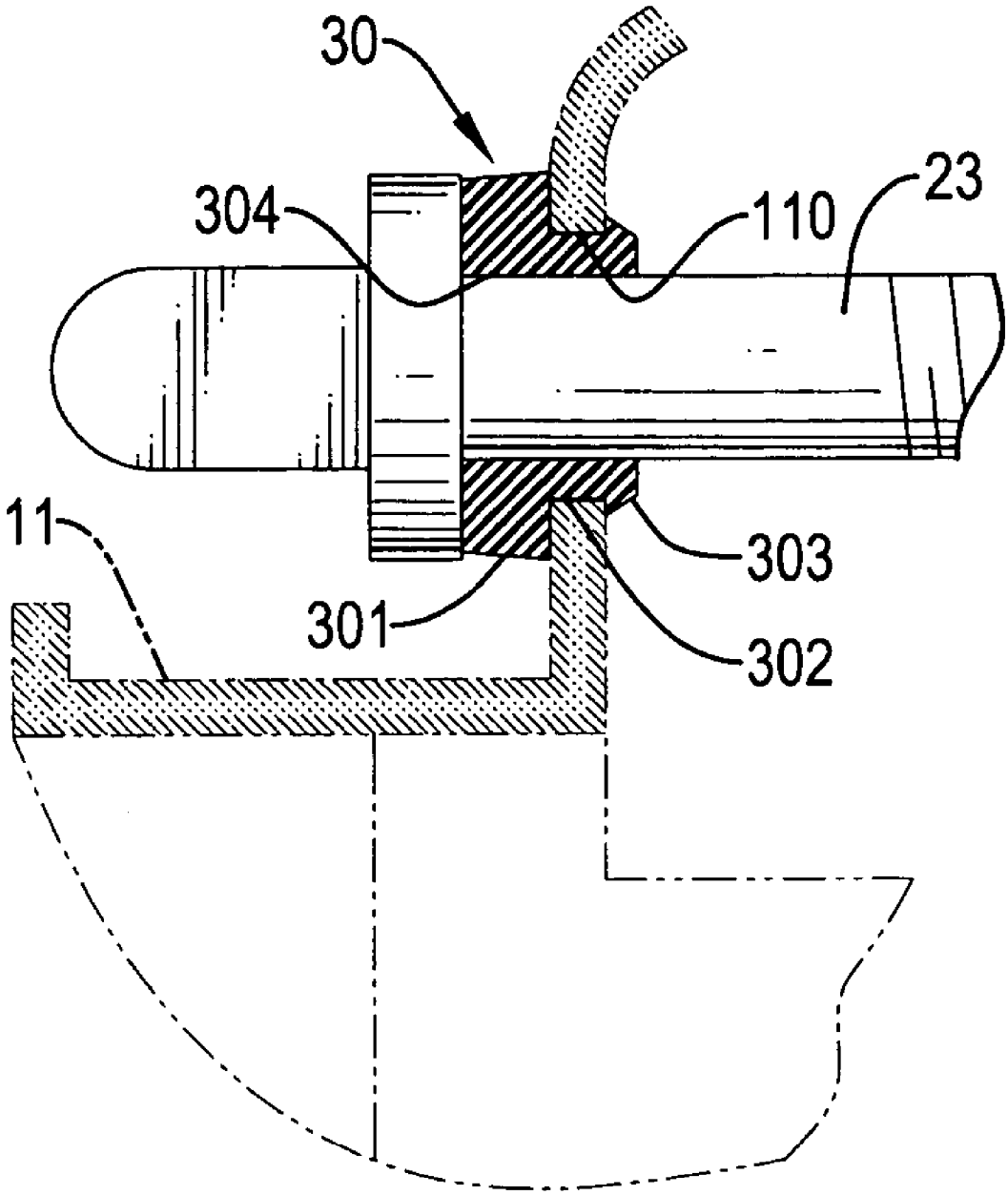
FIG. 3 is an enlarged operational side view in partial section of the captive washer in FIG. 1.
Figure 4:
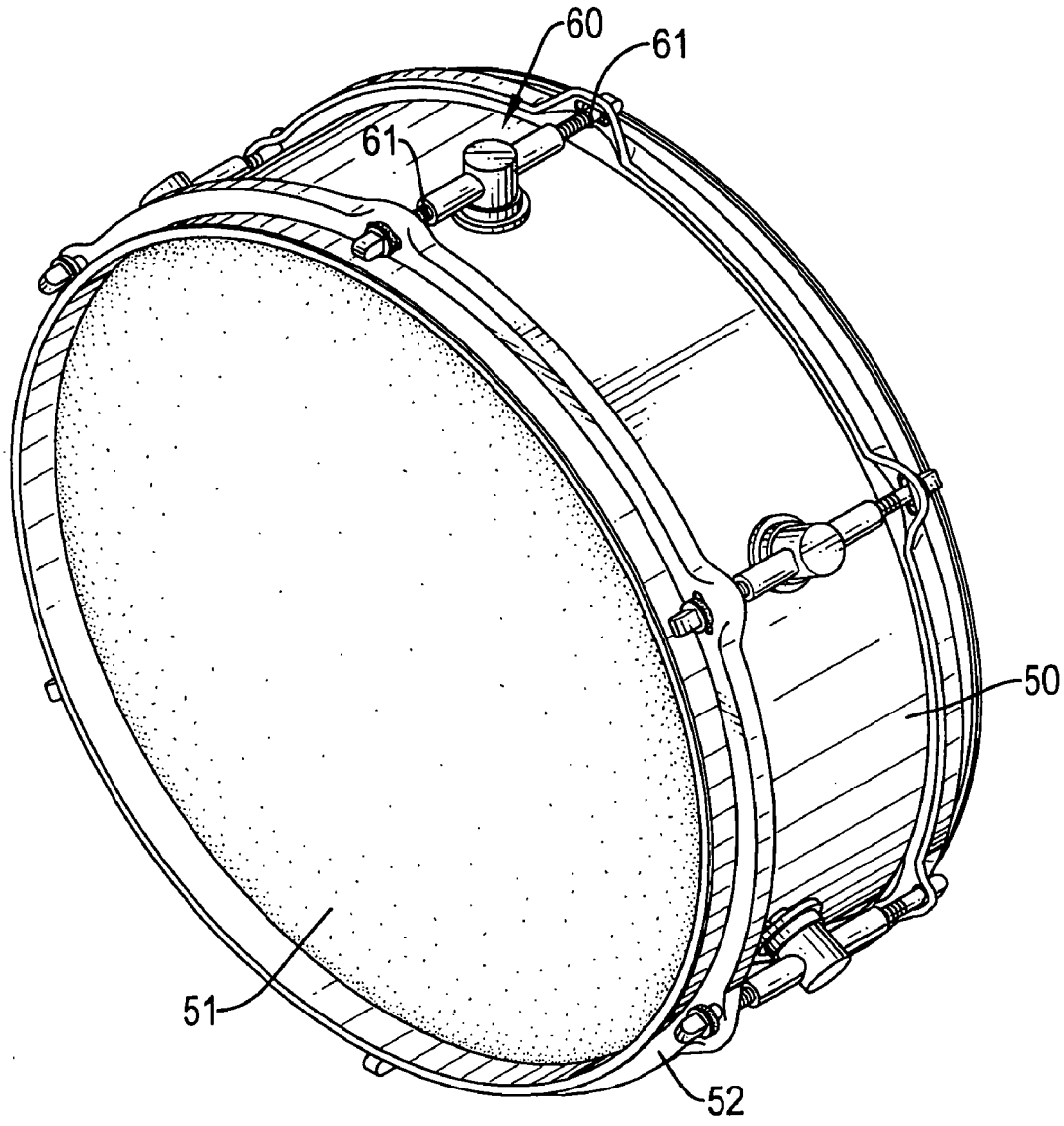
FIG.4 PRIOR ART
FIG. 4 is a perspective view of a drum with conventional tension control devices in accordance with the prior art.
Figure 5:
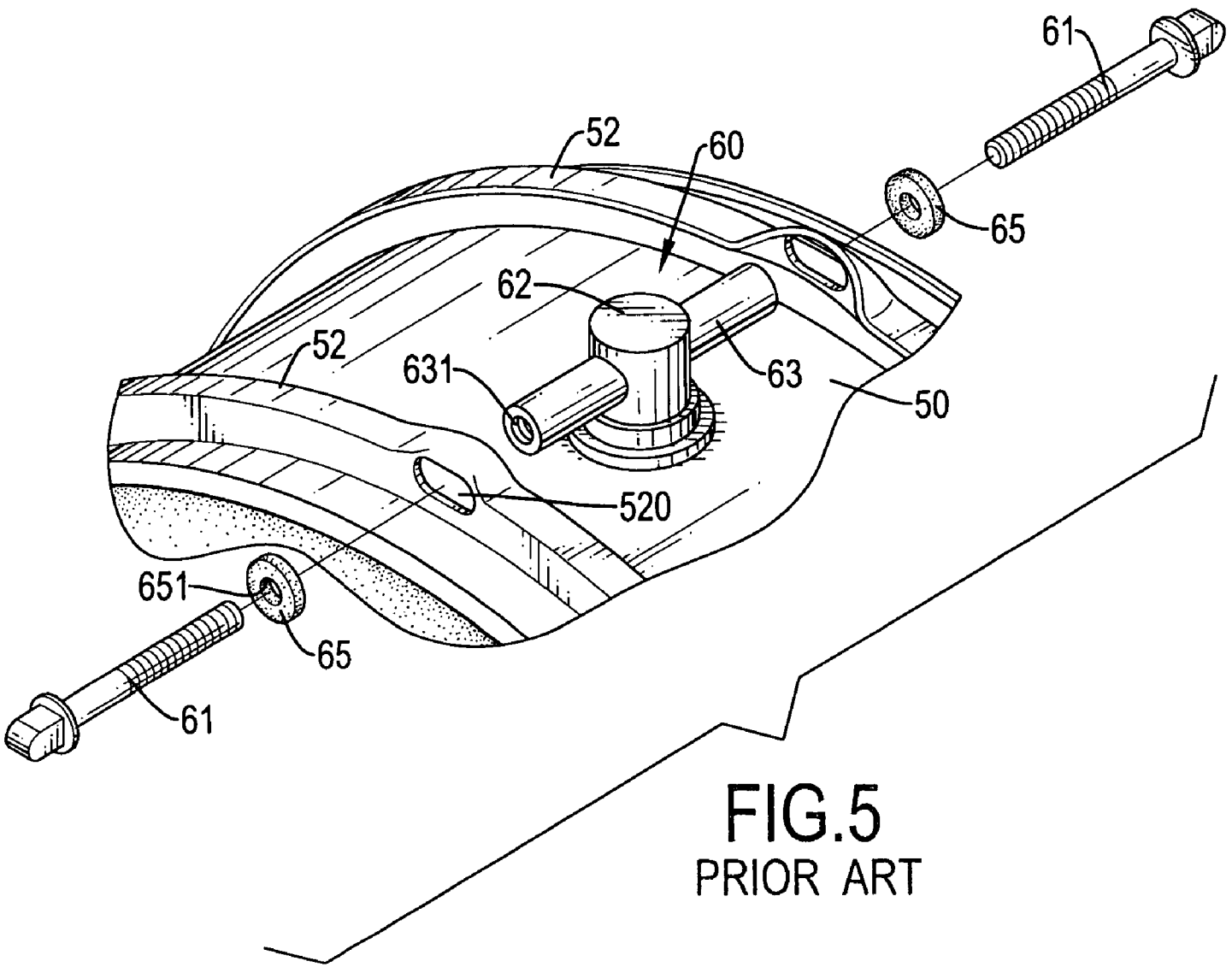
FIG.5 PRIOR ART
FIG. 5 is an enlarged exploded perspective view of the conventional tension control device in FIG. 4.
Figure 6:
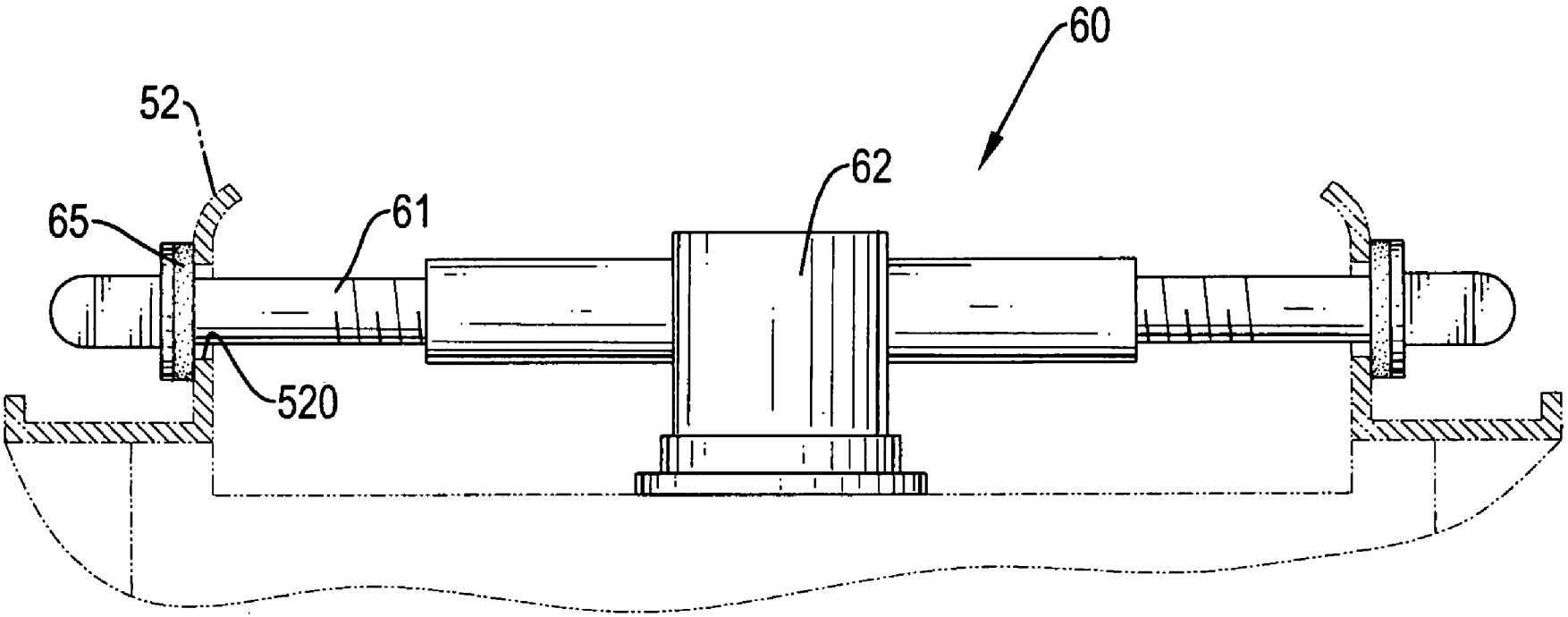
FIG.6 PRIOR ART
FIG. 6 is a side view in partial section of the conventional tension control device in FIG. 4.

With reference to FIGS. 1, 2 and 3, captive washers (30) in accordance with the present invention are used with tension control devices on a drum comprising a cylindrical drum shell (10), two annular drum hoops (11), two drumheads and multiple tension control devices (20). Each annular drum hoop (11) has multiple elongated holes (110) formed circumferentially through the annular drum hoops (11), and each tension control device (20) has a mounting post (21), a connector (22) and two adjusting bolts (23). The connector (22) has an attachment hole (220) extending axially through the connector (22).

The captive washers (30) may be made of plastic, are mounted respectively in elongated holes (110) and press against the drum hoops (11). Each captive washer (30) has an inner end, an outer end, a flange (301), a lip (303), an annular groove (302) and a through hole (304). The flange (301) is formed on and protrudes radially out from the inner end of captive washer (30) and presses against an annular drum hoop (11). The lip (303) is formed around and protrudes radially out from the inner end of the captive washer (30) and engages an elongated hole (110) in an annular drum hoop (11). The annular groove (302) is formed between the flange (301) and the lip (303), engages the elongated through hole (110) in the annular drum hoop (11) to hold the captive washer (30) in the elongated hole (110). The through hole (304) extends longitudinally through the captive washer (30).

The captive washers (30) securely mounted respectively in the elongated holes (110) in the annular drum hoops (11) allow the adjusting bolts (23) to be mounted respectively through the through holes (304) in the captive washers (30) and two screw respectively into opposite ends of the connector (22) to adjust the tension on the drumheads. The flange of the adjusting bolt (23) abuts the flange (301) of the captive washer (30).

The captive washers (30) as described have the following advantages:

1. The captive washers (30) are mounted through the elongated holes (110) in the annular drum hoops (11) and keep the adjusting bolts (23) from contacting and rubbing the elongated holes (110) and the annular drum hoops (11), isolates the adjusting bolts (23) from the vibration of the drum. Then, the tone of the drumheads would not change easily when the drum is played.

2. In addition, when the adjusting bolts (23) are removed to replace or repair the drumheads, the captive washers (30) are retained in the elongated holes (110) in the annular drum hoops (11), which keeps the captive washers (30) from being lost.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A captive washer used with a tension control device on a drum having a cylindrical drum shell, two annular drum hoops having multiple elongated holes formed through the annular drum hoops, two drumheads and multiple tension control devices; with the captive washer having an inner end;

an outer end;

a flange formed on and protruding radially out from the inner end and adapted for pressing against one of the annular drum hoops;

a lip formed around and protruding radially out from the inner end of the captive washer and adapted for engaging one of the multiple elongated holes in a corresponding annular drum hoop, with the lip having a smaller diameter than the flange, with the lip insertable through the one of the multiple elongated holes;

an annular groove formed between the flange and the lip, with the annular groove having a smaller diameter than the lip and adapted for engaging the one of the multiple elongated holes in the corresponding annular drum hoop to hold the captive washer in the one of the multiple elongated holes; and a through hole formed longitudinally through the captive washer from the flange to the lip, with the inner end, the outer end, the flange, the lip, the annular groove and the through hole formed as a single, unseparatable piece.

2. The captive washer as claimed in claim 1, wherein the captive washer is made of plastic.

3. A drum comprising:

a drumshell with an outer surface;

a drumhead connected to the drumshell;

a drum hoop attached to the drumhead, with the drum hoop having a plurality of elongated holes; and a plurality of tension control devices attached to the drum hoop, with each tension control device comprising:

a mounting post connected to the outer surface of the drumshell, a connector having an attachment hole, with the connector attached to the mounting post, a captive washer having a flange, a lip, an annular groove formed between the flange and the lip and a through hole formed longitudinally through the captive washer, with the lip insertable through one of the plurality of elongated holes of the drum hoop, with the annular groove received in one of the plurality of elongated holes of the drum hoop, and an adjusting bolt, with the adjusting bolt insertable in the through hole and threaded into the connector to tighten the captive washer.

4. The drum as claimed in claim 3, wherein the captive washer is made of plastic.

5. The drum as claimed in claim 3, wherein the lip of the captive washer has a smaller diameter than the flange and the annular groove has a smaller diameter than the lip.

6. The drum as claimed in claim 5, wherein the flange, the lip, the annular groove and the through hole are formed as a single, unseparatable piece.

7. The drum as claimed in claim 3, wherein the annular groove of the captive washer is of a size corresponding to the plurality of elongated holes, with the captive washer remaining in one of the plurality of elongated holes when the adjusting bolt is not inserted in the through hole.

* * * * *